United States Patent [19]

Dreyer et al.

[11] 4,210,162

[45] Jul. 1, 1980

[54] HAIR STYLING DEVICE

[76] Inventors: Bernard F. Dreyer, 742 Ludgate Ct.; Paul F. Paglericcio, 220 Cowley Dr., both of Ottawa, Ontario, Canada

[21] Appl. No.: 890,690

[22] Filed: Mar. 27, 1978

[30] Foreign Application Priority Data

Jun. 30, 1977 [CA] Canada ..... 281833

[51] Int. Cl.² ..... A45D 20/00

[52] U.S. Cl. ..... 132/9

[58] Field of Search ..... 132/9, 11 R; 34/92, 34/96, 97; 128/65; 15/2, 158

[56] References Cited

U.S. PATENT DOCUMENTS

| | | | |
|---|---|---|---|
| 918,929 | 4/1909 | Thurman | 132/9 |
| 1,308,685 | 7/1919 | DiSalvio | 15/2 |
| 2,232,218 | 2/1941 | Doty | 132/9 UX |
| 3,903,904 | 9/1975 | Hemrich | 132/9 |
| 3,903,905 | 9/1975 | Tucker | 132/9 |

*Primary Examiner*—G. E. McNeill

*Attorney, Agent, or Firm*—Roylance, Abrams, Berdo & Farley

[57] ABSTRACT

A hair styling device including a housing providing an internal chamber and an opening therein, the chamber having air withdrawn therefrom for causing a vacuum in the chamber so that a lock of hair may be drawn into the chamber for drying and styling. Supplementary air orifices are provided about the opening for supplying air, which is preferably heated, to be drawn into the chamber with the lock of hair so as to assist in the drying process. The device may be manipulated with one hand so that the single lock, which has been drawn into the chamber, may be readily styled during the drying process.

15 Claims, 22 Drawing Figures

HAIR STYLING DEVICE

This invention relates to a hair styling device, and more particularly to a device which may be used to dry ones hair and permit styling of the hair during the drying process.

One of the most common types of hair dryers marketed today includes a hand held unit having an outlet from which heated air is blown. The outlet is held a short distance from the head so that the hair is blown rather violently, and although it is usually desirable to style the hair when it is being dried, the action of the blowing hair makes styling difficult except for those who are skilled in hair styling, such as a professional hair dresser. The process normally involves the use of both hands, one holding the device for properly directing the jet of hot air, and the other working a brush or comb. Moreover, the known devices, particularly if used frequently, can cause scalp dryness. Additionally, the heated blowing air is uncomfortable, and the overall process is not efficient in its use of heated air.

It is an object of the present invention to provide a device which permits controlled grooming of the hair with one hand during the drying process.

According to the invention there is provided a hair styling device which includes a housing forming a suction chamber, the housing defining an opening for entry of one lock of hair at a time into the chamber. The suction chamber has an outlet communicating therewith for permitting continued withdrawal of air from the chamber. Passage means are provided for supplying supplementary air for entry into the chamber and into contact with the lock of hair in the chamber.

Each lock of hair may be dried and styled individually as it is drawn into the suction chamber while the device is held in one hand. Not only is the moisture drawn from the lock, but the supplementary air, which is blown into the suction chamber, is preferably heated, so as to quicken the drying process.

In one embodiment of the invention, the housing defines a peripheral portion about the opening, and orifice means, which communicate with the passage means, are located in the peripheral portion for directing the supplementary air into contact with the lock of hair.

Preferably the orifice means includes openings along the peripheral portion for directing small jets of supplementary air substantially normal to the lock of hair entering the suction chamber. By directing the air normal to the lock of hair, i.e. across the opening into the suction chamber, heated air is not blown directly against the scalp.

Reference is now made to the accompanying drawings, wherein a number of embodiments of the present invention are shown as follows.

Figure 2:
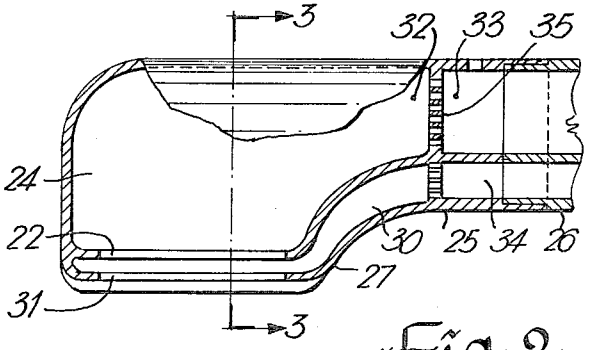
FIG. 2 is a side view of the one embodiment of the device with portions being cut away for the sake of clarity.
Figure 4:
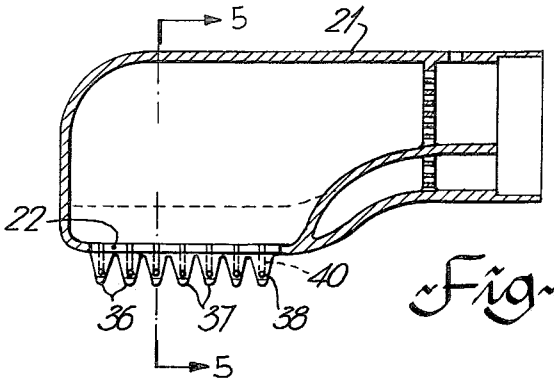
FIG. 4 is a cross-sectional view of another embodiment as seen from line 4—4 of FIG. 5.
Figure 3:
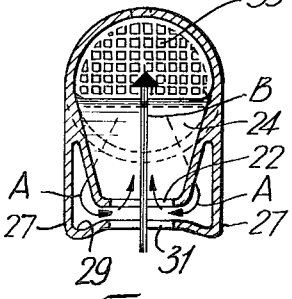
FIG. 3 is a cross-sectional view as seen from line 3—3 of FIG. 2.
Figure 11:
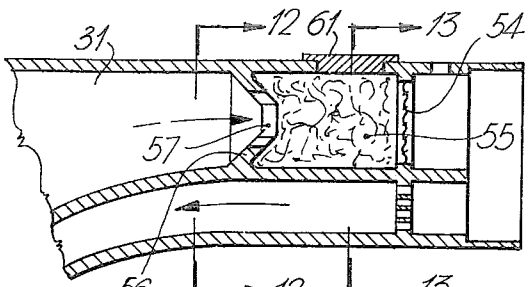
Figure 12:
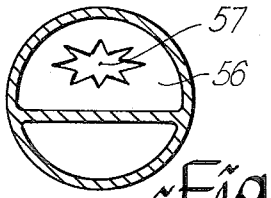
Figure 13:
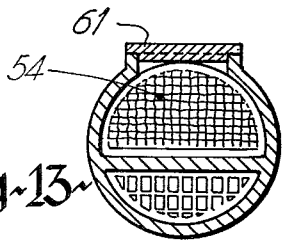
Figure 6:
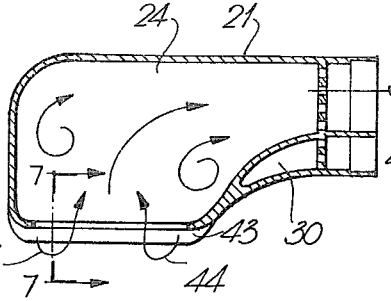
FIG. 6 is a view similar to FIG. 4 of yet another embodiment.
Figure 14:
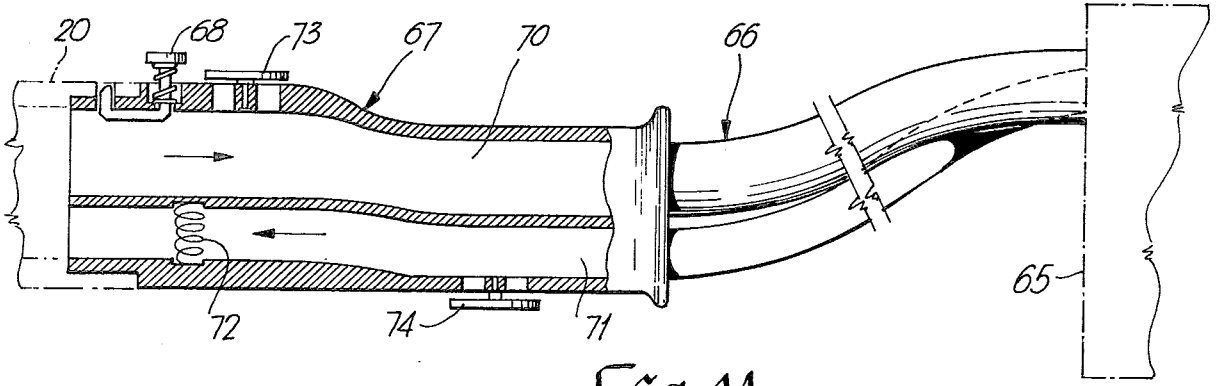
Figure 8:
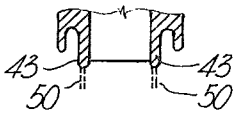
FIGS. 8 to 10 show alternative configurations of the structure of the peripheral portion of the housing about the opening of the suction chamber.
Figure 17:
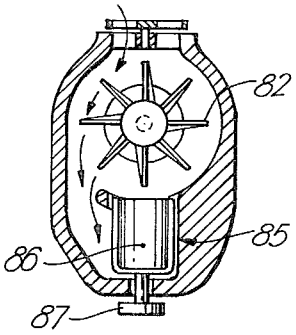
Figure 18:
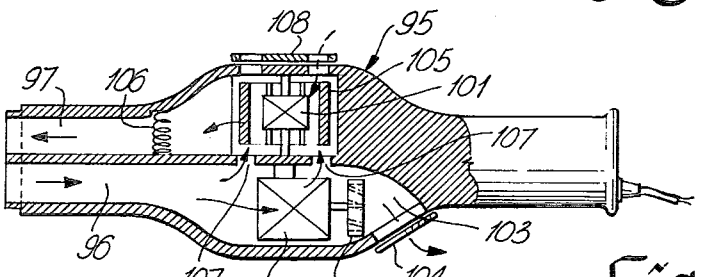
Figure 15:
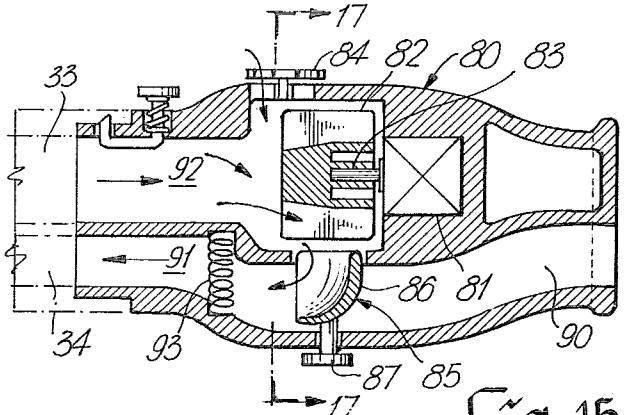
Figure 16:
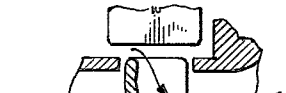
Figure 19:
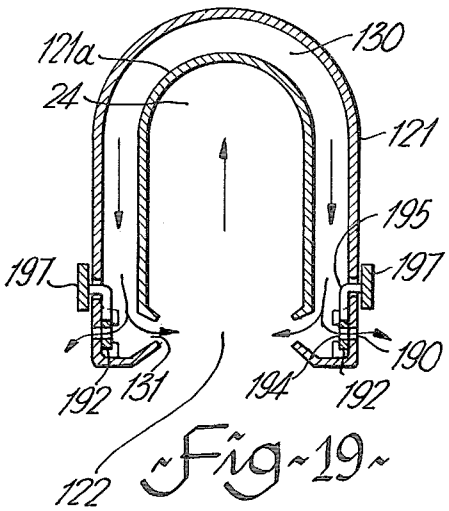
Figure 21:
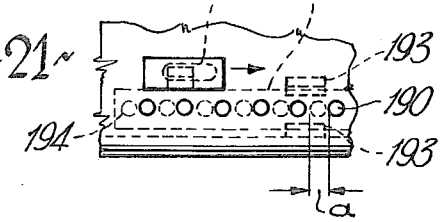
Figure 22:
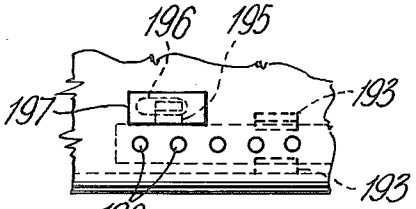
Figure 20:
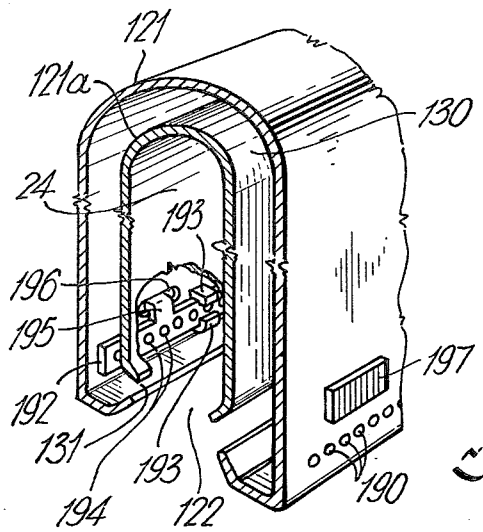

FIG. 11, which appears on the same sheet as FIG. 6, is a partial cross-sectional view showing a hair trap means located in the associated conduits of the device;

FIG. 12, which appears on the same sheet as FIG. 6, is a cross-sectional view taken along line 12—12 of FIG. 11;

FIG. 13, which appears on the same sheet as FIG. 6, is a cross-sectional view taken along line 13—13 of FIG. 11;

FIG. 14, which appears on the same sheet as FIG. 6, is a cross-sectional view through a control device for use in a system wherein vacuum and pressurized air are provided from a central unit;

FIG. 15, which appears on the same sheet as FIG. 8, is a sectional view of a portable motor unit for use in combination with the devices such as those shown in FIGS. 2 and 4;

FIG. 16, which appears on the same sheet as FIG. 8, is a view of an alternative position of a flow control member shown in FIG 12;

FIG. 17, which appears on the same sheet as FIG. 8, is a cross-sectional view taken along line 17—17 of FIG. 12;

FIG. 18 is a view similar to FIG. 12 but of an alternative arrangement:

FIG. 19 is a cross-sectional view similar to FIG. 3 of still another embodiment of the invention;

FIG. 20 is a perspective view of the embodiment of FIG. 19 with portions cut away for sake of clarity;

FIG. 21 is a view of an air flow adjusting device incorporated into the embodiment of FIG. 19; and FIG. 22 is a view the same as FIG. 21 with the adjusting device in a different position.

Figure 1:
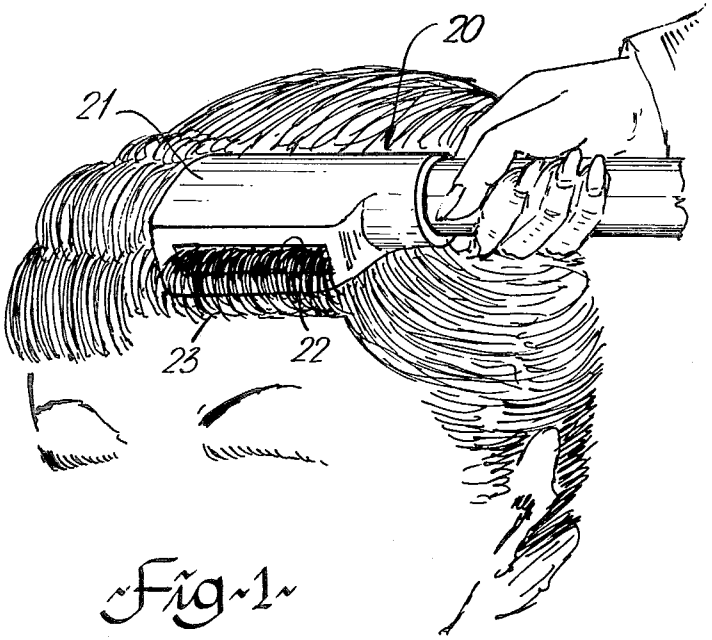
FIG. 1 is a perspective view of the device of the present device being used in a hair drying and styling process.

In FIG. 1, reference number 20 denotes the hair styling device of the present invention, the device having a housing 21 which defines an internal suction chamber (not shown in FIG. 1). The housing defines an opening 22, which allows a lock 23 of hair to be drawn into the suction chamber via the opening 22. The device may be held with one hand, with the lock, which is being dried, received within the suction chamber, and the device may be revolved or otherwise manipulated so as to cause the lock of hair, to be dressed or shaped during a styling process.

As is more clearly shown in FIG. 2, the housing, which may be formed of a moulded plastic, defines an elongated suction chamber 24, which is large enough to receive an entire lock of hair extending inwardly through opening 22. The suction chamber may be of a variety of sizes, depending on whether the device is designed for use with longer or shorter hair. The opening 22 is elongated, extending in the longitudinal direction of the suction chamber, and may have a minimum opening size of about 1"×3", again depending on the type of hair to be styled. The portion of the housing at one end is of reduced size and may form a handle portion 25, or at least a tubular housing section for connection to a suction and air supply member 26. About the opening 22, the housing has outer walls 27 which provide, in association with the portion of the housing forming the suction chamber, passage means 30 for supplying supplementary air for entry into the suction chamber. The outer walls form an opening 31 which may be of the same size and shape as the opening 22 and aligned therewith. Thus supplementary air from the passage means 30 may pass from the peripheral portion about the opening 22 in the direction of arrows A. The supplementary air thus flows generally perpendicular to the lock of hair which is drawn into the suction chamber in the direction of the arrow B. Because of the curved shape 29, the air may be turned slightly toward chamber 24 rather than out of opening 31.

The suction chamber 24 has an outlet 32 through which air may be continually withdrawn so as to provide a pressure in the suction chamber which is less than atmospheric pressure. A filter or grid 35 is provided across the opening so as to prevent any hair from being drawn into conduit 33 in the portion 25. The withdrawal flow rate would normally be no less than about 45 cu. ft. per min. The portion 25 also contains a completely separate conduit 34 which is in communication with passage means 30 and is adapted to be connected to a source of pressurized air, which air is preferably heated before entering the passage means 30.

It may be readily seen that drying and styling of the hair may be easily carried out by manipulating the device 20 with one hand, and the hair is not blown in all directions as occurs with the presently known hair dryers or blowers. The combined effect of the vacuum withdrawing moisture from the air and the heated air contacting the hair and drying it results in efficient and rapid treatment of the hair. The turbulance of the hair within the suction chamber allows the heated air to fully contact each strand of hair. Although the hair is heated even close to the roots, the heated air is not forced directly against the scalp thus avoiding discomfort and possible damage to the scalp.

Figure 5:
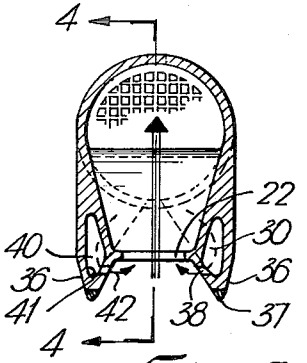
FIG. 5 is a cross-sectional view as seen from line 5—5 of FIG. 4.

The embodiment shown in FIGS. 4 and 5 is similar to that of FIGS. 1 to 3 except that the housing forms a plurality of teeth 36 along opposite sides of the openings 22 and 31, the teeth 36 projecting generally normal to the planes of the openings 22 and 31. The tips 37 of the teeth are preferably soft or at least formed of resilient material. Each tooth is hollow or contains a central passage 40 which communicates at one end with passage means 30 and the other or outer end with an orifice 38. The shape of the passage 40 is preferably curved, as indicated at 41, so that the jet of supplementary air which issues from the orifice 38 curves slightly upward toward the opening 31, as indicated by arrow 42.

The presence of the teeth assists in the styling of the hair and permits scalp massage with the resilient lips of the teeth as the hair is being dried, lock-by-lock.

Figure 7:
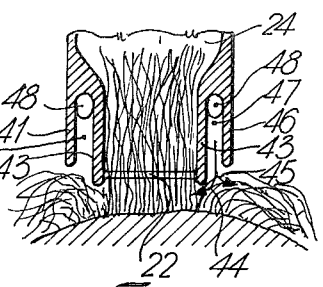
FIG. 7 is a partial cross-sectional view taken along line 7—7 of FIG. 6.

In the embodiment shown in FIGS. 6 and 7, the periphery of the opening 22 is formed by inner wall members 43 which projects from the housing 21. The supplementary or treatment air is provided through passage means 30 to an orifice means which directs the air down the outside wall members 43 substantially parallel to the outside of the wall members in the direction of arrows 44. The air following the direction of arrows 44 is drawn into suction chamber 24 with the lock of hair being dried. Outer wall members 46 are spaced outwardly from the inner wall members 43 so as to provide a space 47 therebetween, the inner and outer wall members being substantially parallel. The supplementary air passes into the space 47 by way of ports 48 communicating with passage means 30. Depending on the depth of outer wall members 46 relative to the inner wall members 43, a portion of the supplementary air may curve outwardly as indicated by arrows 45 to dry some of the hair in the immediate vicinity of the lock being styled. In the embodiment shown in FIGS. 6 and 7, the outer wall members are somewhat shorter than the inner wall members.

Figure 10:
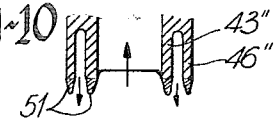
Figure 9:
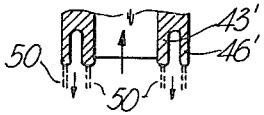

In the embodiment shown in FIGS. 2 and 3, brush bristles could be provided on the peripheral portion of the housing about opening 31. The embodiment shown in FIG. 8, is similar to that shown in FIGS. 6 and 7 except that brush bristles 50 are provided on inner wall members 43 to assist in styling the lock of hair while it is being dried. In the embodiment shown in FIG. 9, inner and outer wall members 43', 46', which have the same depth, are each provided with rows of brush bristles 50. In the embodiment shown in FIG. 10, inner and outer wall members 43", 46" are provided with rows of resilient tips 51.

The device of the present invention may be used not only for drying and styling human hair but also for animals. When being used for grooming the hair of show animals, pet stock, etc. it is particularly useful to provide a hair trap means such as that shown in FIG. 11. In conduit 31, there may be provided in place of the grid 35 a finer screen or filter 54 at the downstream end of a collecting chamber 55. The chamber 55 has an inlet means which is a conical or funnel-shaped wall 56 with a central opening 57. The funnel-shaped wall points in the direction of flow and the opening 57 is preferably of irregular shape as best seen in FIG. 12. The conduit 31 has an opening 60 which provides access to the chamber 55, the opening 60 having a removable closure member 61. The member 61 may be removed to permit cleaning of the chamber 55.

When utilized in a hair dressing shop, a number of the devices 20 may be used simultaneously and be connected to a central source of vacuum and pressurized air, the central source being denoted by reference number 65 in FIG. 14. The device 20 may be connected via a double hose means 66, and with this arrangement there is preferably used in combination with the device a control handle 67 which may be secured to device 20. A locking means 68 is provided which prevents the device from becoming detached unless the locking means 68 is depressed. The control handle 67 has a housing defining conduits 70 and 71 which align with conduits 33 and 34, respectively, of the device 20. The pressurized air may be heated in the central source 65 or the control handle 67 may contain a heater 72. Separate flow control means 73 and 74 are provided in conduits 70 and 71, respectively. Each control means may be in the form of a member for restricting air flow through its respective conduit or in the form of a dial which when turned increases the communication of the conduit with atmosphere. The control means 73 would allow, for example, for air to be drawn in through the control means at an adjustable rate so that as the control means 73 is opened less and less air would be drawn in through the suction chamber 24.

In FIG. 15, there is shown a portable motor unit 80 which may be attached directly to device 20 in the same manner the control handle 67 is attached to it. The motor unit 80 has a single drive motor 81 which is preferably a small electric motor having a fan 82 attached directly to its shaft 83. The fan is rotated in a direction to draw air through conduit 92 which is adapted to be connected directly to conduit 33 of device 24 so as to cause a vacuum in chamber 24. The motor may be a constant speed motor and the amount of vacuum is controlled by a control means 84, which varies the amount of air being drawn into the fan from atmosphere, as was described in connection with control means 73. In the embodiment of FIG. 15 the air being drawn from conduit 92 together with the fresh air entering through control means 84 is blown back to passage means 30 by way of a control valve 85. The control valve 85 includes a curved control vane 86 which may be turned by way of external knob 87. As shown in FIG. 16, if knob 87 is turned through 180° all of the output air of fan 82 is exhausted through conduit 90. Returning the knob 87 through various degrees back to its full recirculation position will account for various pressures in conduit 91 which connects to passage means 30. The air being returned through conduit 91 is exposed to a heater means 93, which may be an electrical heat element having variable control means.

The portable motor unit 95 shown in FIG. 18 may again be attached directly to the device 20, but it provides more accurate control of the vacuum in conduit 96 and pressure in conduit 97 which are adapted to communicate with conduits 33 and 34, respectively of the device 20. The motor unit 95 includes two separate electric motors 100 and 101. Motor 100 has a fan 102 which functions to draw air from conduit 96 and exhaust it through an exhaust conduit 103. An exhaust output control means 104 is provided in conduit 103 for controlling the flow therefrom which thereby controls the magnitude of the vacuum in chamber 24. The motor 101 drives a fan 105 which provides the pressurized air to passage means 30 via conduits 97 and 34, the pressurized air passing a heater means 106. Openings 107 are provided between conduit 96 on the intake of fan 105 so that some of the air being drawn from chamber 24 may be recirculated. The proportion of fresh air being added to the pressurized air is controlled to an intake control means 108. It may be readily seen that by individually adjusting 104 and 106, variations may be made in the magnitudes of the vacuum and air pressure for conduits 96 and 97, as well as the characters of the dryness and heat of the pressurized air.

Additional means may be provided for the injection of a mist which might contain a hair condition solution into the pressurized air supply conduit so that it comes into contact with the hair being styled.

The embodiment shown in FIGS. 19 to 22 has an outer housing 121 and an inner shell or housing **121*a* spaced inwardly therefrom to provide a supplementary air supply chamber 130 arranged to be connected to a source of pressurized conditioned air as described in connection with the other embodiments. The inner shell 121*a* contains the suction chamber 124, and the outer housing together with the inner shell provide an opening 122 through which the lock of air is drawn. About the opening 122 there is formed an opening 131 through which the supplementary air may pass inwardly and be drawn into chamber 124**.

An auxiliary set of ports 190 is provided in the lower portion of the outer housing 121, the ports, when open, allowing air to also flow outwardly around the bottom housing from chamber 130. The ports 190 having adjusting means 191 which can be moved to control the amount of flow through the ports or shut it off altogether. The adjusting means 191 includes a pair of slides 192,192 on opposite sides and mounted in brackets 193,193 projecting inwardly from the outer housing 121 whereby the slide can shift longitudinally of the device. The slides 192,192 have openings 194 having the same spacing as ports 190 so that when openings 194 are aligned with the ports 190 the supplementary air can flow outwardly as indicated by the arrows in FIG. 19. As the slides are shifted relative to the outerhousing 121, the ports are gradually covered to eventually terminate flow through ports 190.

Each slide 190 is provided with a tab 195 which projects outwardly through an elongated slot 196 in the outer housing 121. Fixed to the outer end of the tab 195 is a button 197 which may be engaged by a finger of the user and moved in the direction of the arrow, which is shown in FIG. 21, to open the ports. Movement in the opposite direction achieves closing of the ports whereby adjustment can be made externally of the device. Movement of the slide a distance "a" as shown in FIG. 21 is sufficient to move the slide from a fully closed to a fully opened position, which is shown in FIG. 22, and the distance can be set by selecting the length of slot 196 in which tab 195 is received.

The embodiment shown in FIGS. 19 to 22 allows the user of the device to control the flow of supplementary air around the area of the scalp adjacent the styling device. When the hair is very wet the flow of air past the scalp in using a device such as is shown in FIG. 3 may give a sufficient cooling effect to be uncomfortable. Thus, by opening ports 190 fully, heated air can flow outwardly around the device to give a warming effect on the scalp. As the hair becomes dryer, less of this warming effect is needed and the ports can be gradually closed by shifting buttons 197, which results in all of the heated air flowing directly from the chamber 130 into the chamber 24 for rapid drying of the lock of hair which has been drawn in through opening 122.

Other variations not described above will be apparent to those skilled in the art, which variations are within the spirit of the invention as defined in the appended claims.

We claim:

1. A hand held hair styling device comprising a first housing section forming a suction area for drawing a lock of hair into said area, said housing defining an outlet from said area and a conduit extending from said outlet, said housing including passage means with supplemental air outlets disposed adjacent said area for supplying supplemental air to said suction area and into contact with said lock of hair, a second housing section releasably attached to said first housing section and containing a fan means for withdrawal of air from said conduit and providing pressurized air to said passage means, means for directing at least a portion of the air from said conduit back into said passage means, and conditioning means including a heating element located in the flow of air from said fan means to said passage means.

2. A hair styling device as defined in claim 1, wherein said suction area includes a suction chamber having an opening for entry of said lock into said chamber, said housing defining a peripheral portion about said opening, said peripheral portion including an opening defining an inner wall member projecting from said housing, and wherein said supplementary air outlets are located outside of said wall member for directing air substantially parallel to the outside of said wall member and towards the opening.

3. A hair styling device as defined in claim 1, wherein said suction area includes a suction chamber having an opening for entry of said lock into said chamber, a peripheral portion defined by said housing about said opening, orifice means in communication with said passage means for directing the supplementary air inwardly about at least a part of said peripheral portion, said outlets being located in said peripheral portion for directing supplementary air into contact with the scalp about the lock being dried and means for adjusting the amount of supplementary air flowing through said outlets.

4. A hair styling device as defined in claim 1, wherein said conduit includes a loose hair collection chamber, said collection chamber having an opening with removable closure means normally closing said opening.

5. A hair styling device as defined in claim 1, wherein said fan means includes a single motor driven fan.

6. A hair styling device as defined in claim 1, wherein said fans means includes a first motor driven fan for withdrawing air from said conduit, and a second motor driven fan for pumping air into said passage means, said means for directing comprising by-pass means for permitting flow from said first driven motor fan into said second driven motor fan.

7. A hand held hair styling device as defined in claim 1, wherein said means for directing includes a curved control vane fixedly positioned during such directing.

8. A hair styling device as defined in claim 2, and including an outer wall member spaced outwardly from and substantially parallel to said inner wall member along at least opposite sides of said opening, the supplementary air outlets being provided between said inner and outer wall members.

9. A hair styling device as defined in claim 8, wherein said outer wall member projects from said housing a distance less than the projection of said inner wall member.

10. A hair styling device as defined in claim 8, wherein a row of brush bristles are provided along an edge of at least one of said wall members.

11. A hair styling device as defined in claim 8, wherein at least one of the wall members terminate in the form of a plurality of teeth.

12. A hair styling device as defined in claim 4, wherein said collection chamber is defined between chamber inlet means and chamber outlet means, said outlet means being a filter.

13. A hair styling device as defined in claim 12, wherein said inlet means is in the form of a trap, said trap including a funnel-shaped wall pointing in the direction of flow into said collection chamber, said funnel-shaped wall having a central opening.

14. A hair styling device as defined in claim 6, wherein said second housing section is formed with a port for exhausting air withdrawn by said first motor driven fan, said port having control means for determining the magnitude of the vacuum in said suction chamber.

15. A hair styling device as defined in claim 6, wherein said second housing section is provided with a port for entry of external air into said second motor driven fan, said port having control means for determining the magnitude of the pressure of air supplied to said passage means.

* * * * *